US005245959A

United States Patent [19]

Ringenbach

[11] Patent Number: 5,245,959

[45] Date of Patent: Sep. 21, 1993

[54] AIR BYPASS SPARK PLUG

[76] Inventor: Peter C. Ringenbach, 211 Highland Ave., Buffalo, N.Y. 14222

[21] Appl. No.: 941,902

[22] Filed: Sep. 8, 1992

[51] Int. Cl.[5] ..... F02P 13/00; H01T 13/02

[52] U.S. Cl. ..... 123/169 V; 313/120

[58] Field of Search ..... 123/169 R, 169 V, 26; 313/120

[56] References Cited

U.S. PATENT DOCUMENTS

| | | | |
|---|---|---|---|
| 1,754,796 | 4/1930 | McEroy | 123/169 V |
| 2,994,310 | 8/1961 | Hopwood | 123/26 |
| 3,019,777 | 2/1962 | Candelise | 123/26 |
| 3,204,139 | 8/1965 | Candelise | 313/120 |
| 3,735,740 | 5/1973 | Hunt | 123/26 |
| 4,232,242 | 11/1980 | Hsu | 313/120 |
| 4,325,332 | 4/1982 | Hukill | 123/169 PA |
| 4,469,059 | 9/1984 | Hukill | 123/169 V |
| 4,513,220 | 4/1985 | Togashi | 313/120 |

*Primary Examiner*—Andrew M. Dolinar

*Attorney, Agent, or Firm*—Bean, Kauffman & Spencer

[57] ABSTRACT

This invention relates to a novel ignition plug, for use in an internal combustion engine, that has an insulator comprising a hollow decompression chamber arranged about a central electrode, an air injection inlet and multiple outlets sized to restrain the flow of combustible gases from a combustion cylinder to the chamber when the cylinder is undergoing a compression stroke.

9 Claims, 2 Drawing Sheets

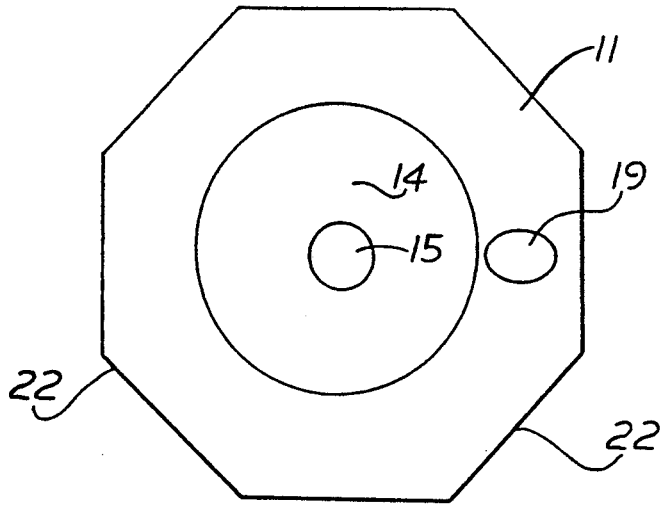
FIG. 2.
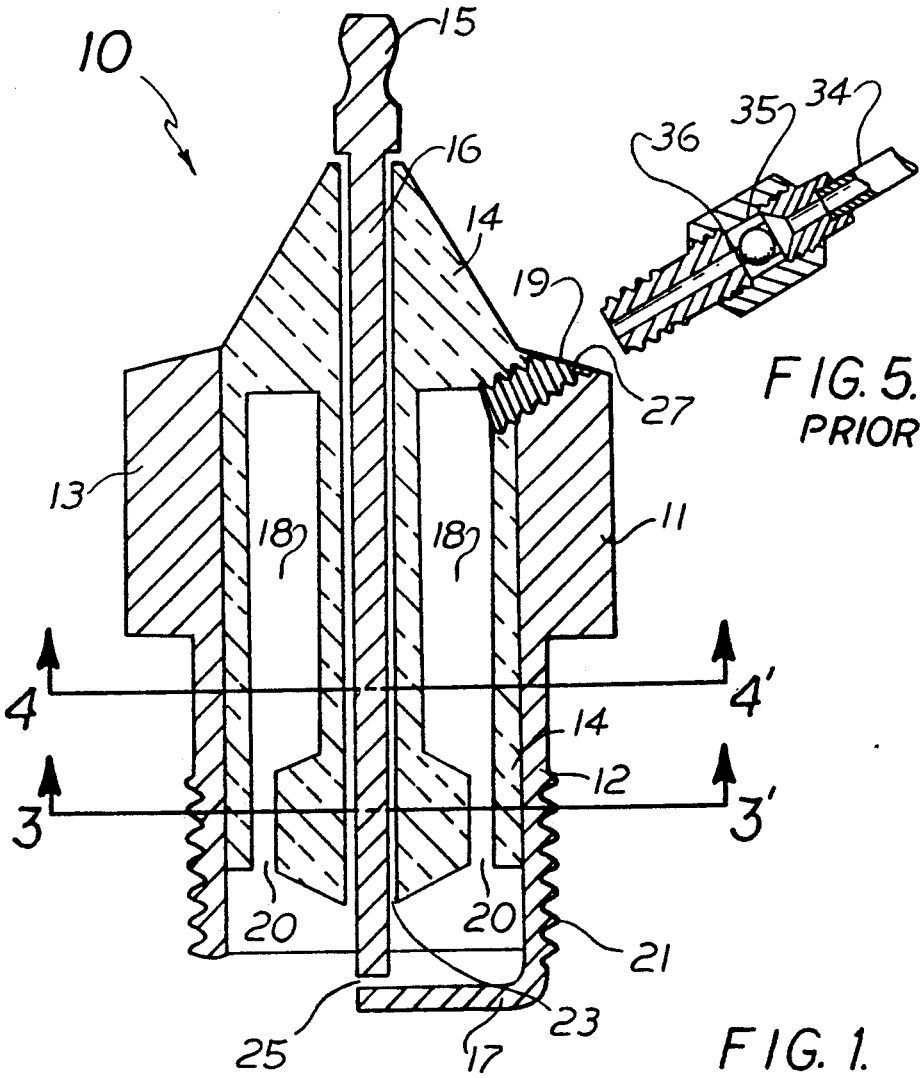
FIG. 5.
PRIOR ART
FIG. 1.

AIR BYPASS SPARK PLUG

This invention relates to a novel spark plug that comprises an air decompression chamber and has particular utility in an air injection system of an internal combustion engine.

BACKGROUND OF THE INVENTION

In recent years it has become increasingly desirable to improve the combustion of the compressed gas mixture in an internal combustion engine to reduce the levels of pollutants released to the atmosphere and provide improved efficiency of the engine for higher gas mileage.

One method of improving the efficiency is to supply additional air to the compressed gas mixture during the period of flame propagation in the combustion cylinder. This may be accomplished by introducing air, under substantially constant pressure, to a combustion cylinder at a time when the pressure within the combustion cylinder is less than the pressure of the constant pressure air and interrupting the supply of constant pressure air when the pressure within the combustion cylinder exceeds the constant pressure.

To achieve such interruptable air supply, elaborate methods and apparatus have been devised that comprise one or more check valves that operate to open and close passage from the constant pressure air supply source, in response to differentials between the constant pressure of the air supply and the pressure changes within the combustion cylinder. Such systems have included air supply inlets at various locations within the combustion cylinder and have included elaborate spark plugs configured with passageways to provide an inlet to the combustion cylinder.

Spark plugs have been proposed that contain various passageways for air transmission through the spark plug to the combustion cylinder. Some have even proposed using a hollow central electrode for a passageway but none appear to have enjoyed widespread commercial success. The problem has been that regardless of the type of system heretofore proposed for a spark plug passageway, the back-pressure on the air inlet mechanism produced by the combustion process is so great that there is a tendency for the system to break down and/or become fouled with carbon deposits thus significantly reducing the useful life of the spark plug.

It is an object of this invention to provide an improved spark plug for injecting air into the combustion cylinder of an internal combustion engine.

It is another object of this invention to provide a spark plug for an air-injection system that reduces compression back pressure to the system.

It is a further object of this invention to provide an air-injection spark plug which will promote a more complete combustion of the air-fuel mixture within the combustion cylinder resulting in a cleaner-burning less polluting engine operation.

It is yet another object of this invention to provide an air-injection spark plug which will be self-cleaning.

It is yet a further object of this invention to store a portion of the products of combustion, such products being hot gases, under pressure in an auxiliary pressure reducing chamber and subsequently release the hot gases back into the compression chamber of the cylinder, thus raising the temperature of the gases in the next compression cycle.

These and other objects of this invention are accomplished by providing an air-injection system in a spark plug comprising a decompression chamber with multiple inlets extending to the combustion cylinder.

SUMMARY OF THE INVENTION

The invention relates to an improved ignition plug useful in an internal combustion engine. The plug comprises an elongate, generally cylindrical, hollow housing, having a first end adapted to be secured to an engine cylinder and an opposite end having an insulator extending therethrough which comprises a central terminal for connecting to the ignition system of the engine. The central terminal is contiguous with a center electrode which passes through a central bore in the insulator and has an end in gaped juxtaposition with a ground electrode attached to the threaded end.

The insulator is configured to support the center electrode in electrically insulated arrangement through said housing, and has a hollow decompression chamber therein which encircles the central bore through which the center electrode passes. An air-injection inlet passes through an upper portion of the housing, through the insulator to the hollow decompression chamber. The insulator has air-injection outlets leading from the hollow decompression chamber through the insulator to the first end of the housing. The outlets are arranged peripheral to the central bore, between the central electrode and the housing, and are sized to provide a total cross-sectional area that is about the same or greater than the cross-sectional area of the air-injection inlet.

During the operation of the ignition plug of the invention in a standard four stroke internal combustion engine, air is continuously passed through the air-injection inlet through the decompression chamber out the four outlets into an engine cylinder at a constant pressure. During the compression stroke, as the compression of combustible gas within the cylinder reaches the pressure of the air being injected, a check valve in the air-injection system interrupts and prevents a reversal of air flow through the air injector system. The interruption traps a volume of injected air between the check valve and the outlets of the decompression chamber. The reduced size of the inlet and outlets to and from the larger volume decompression chamber, restrains the backward flow of fuel from the cylinder toward the check-valve. Thus, the compression of gases in the chamber proceeds at a different rate and with a leaner fuel to air mixture than that within the cylinder. At ignition, the compressed leaner fuel to air mixture in the chamber can provide an oxygen rich source stream through the chamber outlets that can extend the propagation of the flame, thereby boosting the efficiency of fuel ignition while clearing carbonation from the outlets of the decompression chamber.

For a full understanding of the invention and the principles thereof, reference is hereinafter made to the following description of typical embodiments thereof as illustrated in the accompanying drawings.

BRIEF DESCRIPTION OF THE DRAWINGS

FIG. 1 is a longitudinal sectional view of the ignition plug of the invention.

FIG. 2 is a top plan view of the ignition plug of FIG. 1.

FIG. 5 is an enlarged sectional view of a check valve suitable for use in the invention .

DETAILED DESCRIPTION OF THE DRAWINGS

Figure 3:
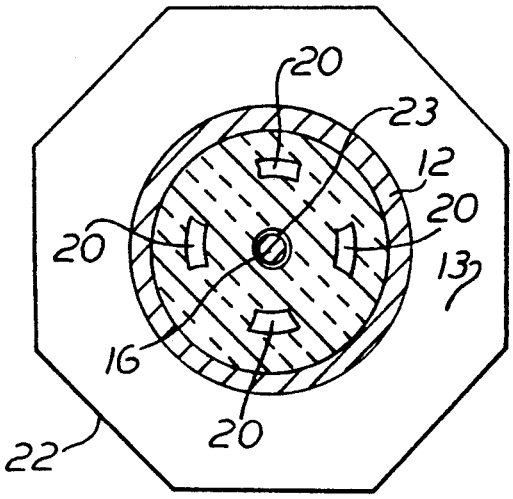
FIG. 3 is a sectional view of the ignition plug of FIG. 1 taken along line 3—3′.
Figure 4:
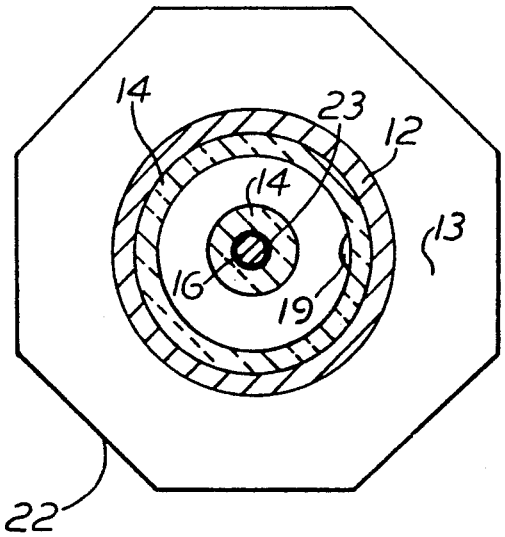
FIG. 4 is a sectional view of the ignition plug of FIG. taken along line 4—4'.

Referring now to the drawings wherein is illustrated an ignition plug embodying the invention. In the figures, ignition plug 10 is illustrated as comprising a housing 11 having a first end portion 12 comprising threads 21 which engage a threaded portion of an internal combustion engine cylinder for securing the ignition plug thereto. The opposite end portion 13 of housing 11 comprises a multi-sided surface 22 configured to engage a tool for engaging the ignition plug to the cylinder. Insulator 14 engages the interior surface of housing 11 and extends outwardly from opposite end portion 13 of the housing. The insulator has a central bore 23 which comprises center electrode 16, one end of which terminates at central terminal 15 and the other end of which terminates in gaped juxtaposition with ground electrode 17. Though the embodiment of the figures show central terminal 15 as formed from the end of electrode 16, it should be understood that it is contemplated as being within the invention that central terminal 15 be removable, such as by being internally threaded for engaging cooperating threads at the end of the center electrode. A spark plug wire is connected to central terminal 15 preferably by removable clip means or the like or may be secured between a threaded electrode and cooperatively threaded central terminal.

Central electrode 16 extends through central bore 23 of insulator 14 from the terminal 15 to first end portion 12, where it is in gaped juxtaposition with ground electrode 17. Ground electrode 17 is conductively connected to first end portion 12 of housing 11. Gap 25 is adjustable, typically by bending electrode 17 into varying positions relative to the end of electrode 16, such that an electric voltage imposed through a circuit comprising electrode 16 and ground electrode 17, can be caused to spark across the gap to complete a circuit.

Insulator 14 comprises decompression chamber 18 which is arranged peripherally about center electrode 16 and comprises air injector inlet 19 and outlets 20 which are also arranged peripherally about center electrode 16. Inlet 19 is illustrated as comprising threads 27 for engaging a fitting which connects the air injection source to the ignition plug. Generally, such fitting includes a check valve or the like which can interrupt the flow of injected air when an appropriate back pressure is sensed. FIG. 5 illustrates a typical check valve as disclosed at page 2, lines 96–102 of U.S. Pat. No. 1,754,796 to McElroy wherein a spark plug is shown as communicating through a conduit 34 having therein a check valve 35 which acts in one direction being precluded by a pin 36 from seating in a rearwardly direction. It should be understood that it is contemplated as within the invention to use means other than threaded means to engage the air injection system and that a check valve or the like may be positioned at a point in the air injection system more remote from the ignition plug than such connecting fitting.

The total combined cross-sectional area of the orifice of outlets 20 is sized to be about the same or greater than the cross-sectional area of the orifice of inlet 19. In the embodiment depicted in the drawings, four outlets are illustrated as having borders wholly confined within the insulator. It should be understood that an outlet may border the central electrode and/or the housing.

The housing is generally comprised of a conductive metal for strength and resistance to degradation. The insulator is typically comprised of a porcelain material, however it is contemplated within the invention to include other insulating materials that are resistent to the degradation of explosive combustion such as various ceramics and the like. Generally the center electrode and/or the ground electrode are comprised of metal alloys that are particularly conductive and resistent to wear occasioned by the spark jumping between the gap.

In a conventional four cycle internal combustion engine, the piston moves in a downstroke which increases the volume of the cylinder which in turn allows air and fuel to be sucked into or otherwise provided the cylinder. Generally, a fuel/air mixture is provided to the cylinder through a valve port or the like from a carburetor or a fuel injector. After reaching its maximum travel, the piston reverses direction moving upward to reduce the available volume of the cylinder, while the valve port or the like closes to prevent fuel/air mixture from escaping. As the fuel/air mixture is compressed to the smallest volume reached by the pistons upward travel in the cylinder, the ignition plug receives a high voltage surge that sparks across the gap between the center electrode and the ground electrode of the ignition plug which in turn causes the compressed gases to ignite. The igniting gases expand and drive the piston downwardly in a power stroke. The piston reverses direction at its maximum downward position and moves upwardly, again reducing the volume of the cylinder. Spent gases are pushed out of the cylinder through an exhaust gas valve port or the like during the upward stroke. At the top of its upward stroke, the piston reverses direction, the exhaust gas valve port closes and new fuel/air mixture is sucked into the cylinder by the downward movement of the piston.

In the operation of the system of the invention, the injection air source provides a constant air pressure such that when the piston moves in its downstroke and receives a fuel/air mixture, the check valve of the air injection system is open and air is injected at a constant pressure through inlet 19 to decompression chamber 18 and through outlets 20 to the increasing volume of the cylinder. After reaching its maximum travel, the piston reverses direction moving upward to reduce the available volume of the cylinder, while the valve port or the like closes to prevent fuel/air mixture from escaping. As the fuel/air mixture is compressed by the upstroke of the piston, the back pressure in the cylinder equals and then exceeds the air injection pressure and the check valve of the air injection system closes confining the fuel air mixture to the decreasing volume of the cylinder and preventing reversal of fluid flow. The decompression chamber generally contains a trapped, pressurized charge of air from the air injection system and the sizing of the orifices of the outlets therefrom resists backward flow of the fuel/air mixture therein. The pressure within the decompression chamber rises to approach that within the cylinder but generally contains a leaner fuel:air ratio than the average of the mixture in the cylinder. The fuel/air mixture is compressed to the smallest volume reached by the pistons upward stroke in the cylinder and is ignited by the ignition plug. Ignition of the mixture in the cylinder is accompanied by compressed air flow from the decompression chamber to the oxygen depleted cylinder providing a longer, hotter and more efficient ignition of the fuel/air mixture. The igniting gases expand and drive the piston downwardly in a power stroke which in turn decreases the pressure within the cylinder allowing the check valve to open and injected air to enter.

The injected air flows from the outlets of the decompression chamber into the cylinder forcing flow through of spent exhaust gases through the exhaust valve port as the piston moves upwardly in its exhaust stroke. At the closing of the exhaust port and opening of the fuel inlet port, the process begins again.

The illustrated embodiment of the invention is intended to exemplify the invention and other specific forms may be embodied without departing from the spirit and scope of the invention.

I claim:

1. An improved ignition plug for an internal combustion engine comprising:

an elongate housing, having a first end comprising a ground electrode, said end being adapted to be secured to an engine cylinder;

an insulator, inserted in said housing and extending from another end of said housing, said insulator having a center electrode passing therethrough;

said electrode having a terminal extending from said insulator at said another end of said housing and extending from said insulator at about said first end of said housing in gaped juxtaposition to said ground electrode;

wherein said insulator comprises a hollow chamber, arranged peripherally about said center electrode, said hollow chamber having an air injection inlet passing through said housing and said insulator to said chamber, and multiple air injection outlets, arranged peripheral to said center electrode, and passing through said insulator to said first end of said housing;

said outlets of said chamber being sized to restrain the flow of combustible gases from said engine cylinder to said chamber when the cylinder is undergoing compression.

2. An ignition plug of claim 1 wherein the total of the cross-sectional area of the orifices of the multiple air injection outlets is at least about the same as the cross-sectional area of the orifice of the air injection inlet.

3. An ignition plug of claim 1 wherein said air injection inlet comprises means for preventing reversal of fluid flow therethrough.

4. An ignition plug of claim 3 wherein said means for preventing reversal comprises a one-way check valve.

5. An ignition plug of claim 1 wherein said air injection inlet is threaded for engagement to a cooperative threaded fitting.

6. An ignition plug of claim 5 wherein said fitting comprises a one-way check valve.

7. An ignition plug of claim 1 wherein said air injection outlets are in spaced arrangement about the periphery of said center electrode.

8. An ignition plug of claim 7 comprising four air injection outlets.

9. An ignition plug of claim 1 wherein said hollow chamber encircles said center electrode.

* * * * *